US006971732B1

(12) United States Patent
Seshimo et al.

(10) Patent No.: US 6,971,732 B1
(45) Date of Patent: Dec. 6, 2005

(54) INK JET RECORDING APPARATUS

(75) Inventors: Tatsuya Seshimo, Nagano (JP); Takahiro Naka, Nagano (JP); Satoshi Shinada, Nagano (JP); Yukihiro Uchiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/688,187

(22) Filed: Oct. 16, 2000

Related U.S. Application Data

(63) Continuation of application No. PCT/JP00/00821, filed on Feb. 15, 2000.

(30) Foreign Application Priority Data

| | | |
|---|---|---|
| Feb. 15, 1999 | (JP) | P. 11-036116 |
| Feb. 15, 1999 | (JP) | P. 11-036117 |
| May 21, 1999 | (JP) | P. 11-140924 |
| May 27, 1999 | (JP) | P. 11-147456 |
| Sep. 10, 1999 | (JP) | P. 11-256752 |

(51) Int. Cl.[7] ..... B41J 29/393
(52) U.S. Cl. ..... 347/19; 347/5
(58) Field of Search ..... 347/19, 86, 7, 347/23, 5

(56) References Cited

U.S. PATENT DOCUMENTS

| | | | | |
|---|---|---|---|---|
| 5,455,606 A | * | 10/1995 | Keeling et al. | 347/7 |
| 5,699,091 A | * | 12/1997 | Bullock et al. | 347/19 |
| 5,727,135 A | * | 3/1998 | Webb et al. | 358/1.14 |
| 5,764,251 A | * | 6/1998 | Hashimoto | 347/19 |
| 5,835,817 A | | 11/1998 | Bullock et al. | 347/19 |
| 6,053,595 A | | 4/2000 | Otsuka et al. | |
| 6,065,824 A | * | 5/2000 | Bullock et al. | 347/19 |
| 6,102,508 A | * | 8/2000 | Cowger | 347/19 |
| 6,113,208 A | | 9/2000 | Benjamin et al. | |
| 6,116,716 A | | 9/2000 | Tajika et al. | |
| 6,155,664 A | * | 12/2000 | Cook | 347/19 |
| 6,158,837 A | * | 12/2000 | Hilton et al. | 347/19 |

FOREIGN PATENT DOCUMENTS

| | | | |
|---|---|---|---|
| EP | 0 854 044 A2 | 7/1998 | |
| EP | 0 878 305 | 11/1998 | B41J 2/05 |
| EP | 0 878 307 A2 | 11/1998 | |
| JP | 3-67657 A | 3/1991 | |
| JP | 5-193127 | 8/1993 | B41J 2/01 |
| JP | 05-270012 A | 10/1993 | |
| JP | 7-227971 | 8/1995 | B41J 2/175 |
| JP | 8-58082 A | 3/1996 | |
| JP | 8-310007 | 11/1996 | B41J 2/175 |
| JP | 10-024590 A | 1/1998 | |
| JP | 10-069139 A | 3/1998 | |
| JP | 10-217509 A | 8/1998 | |
| JP | 10-323999 A | 12/1998 | |
| JP | 11-342623 | 12/1999 | B41J 2/175 |
| WO | WO 98/52762 | 11/1998 | |

* cited by examiner

*Primary Examiner*—K. Feggins
*Assistant Examiner*—Julian D. Huffman
(74) *Attorney, Agent, or Firm*—Sughrue Mion, PLLC

(57) ABSTRACT

In an ink jet recording apparatus comprising an ink jet recording head 3 for receiving supply of ink from an ink cartridge 4 provided with a storage device 7 storing data for determining compatibility to a recording apparatus, and a print controller 10 for determining compatibility of ink based on the data in the storage device 7 and executing the print operation, when an ink cartridge 4 is mounted, if compatibility to the ink cartridge 4 cannot be confirmed, a caution is given and the recording apparatus awaits an input of a continuation instruction by a user to execute a subsequent operation. Even if a cartridge whose compatibility cannot be confirmed is mounted, printing is enabled as much as possible without incurring damage to the recording apparatus.

28 Claims, 13 Drawing Sheets

FIG. 8

STORAGE INFORMATION TABLE

| | | |
|---|---|---|
| 1 | MANUFACTURING YEAR (LOW-ORDER ONE DIGIT, 4) | ···0000~1001 (0~9) |
| 2 | MANUFACTURING MONTH (LOW-ORDER TWO DIGITS, 4) | ···0001~1100 (1~12) |
| 3 | MANUFACTURING DAY (LOW-ORDER TWO DIGITS, 8) | ···0000 0001~0011 0001 (01~31) |
| 4 | ATTACHMENT YEAR (LOW-ORDER ONE DIGIT, 4) | ···0000~1001 (0~9) |
| 5 | ATTACHMENT MONTH (LOW-ORDER TWO DIGITS, 4) | ···0001~1100 (1~12) |
| 6 | ATTACHMENT DAY (LOW-ORDER TOW DIGITS, 8) | ···0000 0001~0011 0001 (01~31) |
| 7 | INK TYPE (4) | ···0000~1111 (0~F) |
| 8 | COLOR INFORMATION (8) | ···0000 0000~1111 1111 (00~FF) |
| 9 | DATA INDICATING CARTRIDGE TYPE OF DESTINATION, CONTENT AMOUNT AND ETC. OF THE CARTRIDGE (8) | |
| 10 | INFORMATION INDICATING MODE OF OPTIMUM INK SEQUENCE (8) | |
| 11 | INK REMAINING AMOUNT (142) | |
| 12 | INFORMATION INDICATING THE MANUFACTURING LINE (4) | |

INK JET RECORDING APPARATUS

CROSS-REFERENCE TO RELATED APPLICATIONS

This is a continuation application of International Application No. PCT/JP00/00821 filed on Feb. 15, 2000.

TECHNICAL FIELD

This invention relates to a recording apparatus for receiving supply of ink from a replaceable ink cartridge and printing on a print medium while ejecting ink droplets through nozzle openings.

BACKGROUND OF THE INVENTION

For example, an ink jet recording apparatus comprises a recording head in which a drive signal is supplied to piezoelectric vibrators, heating means, etc., in response to print data and ink is pressurized by energy produced by the piezoelectric vibrators, the heating means, etc., to eject ink droplets through nozzle openings, and an ink cartridge storing ink to be supplied to the recording head.

The print quality not only is determined by the resolution of the recording head, but also depends largely on the viscosity of ink, the blurred state of ink on a print medium, etc. Therefore, the ink characteristics are improved for upgrading the print quality. The recording head drive method is also improved to be suitable for the ink characteristics even in a case where ink is unchanged. Further, the maintenance conditions, such as idle ejection cycle and forcible ejection in a capped state, are improved to prevent clogging in nozzle openings.

The results of such improvements can be reflected on a recording apparatus on the user side by storing data in semiconductor means attached to an ink cartridge, as disclosed in JP-A-5-193127.

With such ink cartridge, optimum print can be realized by changing the ink type not only for different models of the recording apparatuses but also for the same recording apparatus in order to meet print quality improvement of the recording apparatus side and various needs. However, there is a disadvantage in that a mistake easily occurs in selection of ink corresponding to the print purpose, and printed material having the intended quality cannot be obtained.

Thus, as disclosed in JP-A-8-310007, a recording apparatus is proposed, in which an ink cartridge is provided with storage means attached thereto that stores identification data indicative of the type of the ink cartridge, and comparison data for determining whether or not each ink cartridge is compatible is stored in the recording apparatus. When an ink cartridge is mounted to the recording apparatus, it is determined based on the data in the storage means as to whether or not the ink cartridge is compatible to the recording apparatus. If the ink cartridge is not compatible, the subsequent operation is inhibited to await replacement of the ink cartridge with a compatible ink cartridge.

The recording apparatus can be operated in the optimum state, but if a compatible ink cartridge is not in hand, printing is completely impossible. This is inconvenient in a case where urgent printing is required.

Further, if the data in the storage means attached to the ink cartridge is lost or cannot be read, printing is impossible.

It is, therefore, a first object of the invention to provide a recording apparatus which, even if an incompatible cartridge is mounted, informs the user of the compatibility of the mounted cartridge based on the data stored in storage means attached to the ink cartridge, and enables the printing on user's own authority.

It is a second object of the invention to provide a recording apparatus which, if data can be read from storage means attached to an ink cartridge, can create prints with high quality based on the data, and which enables printing even if data cannot be read.

DISCLOSURE OF THE INVENTION

The invention is directed to an ink jet recording apparatus comprising an ink jet recording head for receiving supply of ink from an ink cartridge provided with storage means storing data for determining compatibility to recording apparatuses, and control means for determining compatibility of ink based on the data in the storage means and executing print operation. In the ink jet recording apparatus, if compatibility of an ink cartridge cannot be confirmed when the ink cartridge is mounted, a caution is given as well as input of a continuation instruction from a user is awaited to execute a subsequent operation.

Thus, if compatibility of the ink cartridge cannot be confirmed, the subsequent operation, such as filling the recording head with ink, can be executed based on confirmation by the user, and therefore it is possible to eliminate damage on the recording head due to improper ink filling, and avoid waste print sheets. Even in a case where the compatibility cannot be confirmed due to trouble of the recording apparatus side, a forcible transition to the print operation can be realized, and user's complaint can be solved.

The present disclosure relates to the subject matter contained in Japanese patent application Nos.:

Hei. 11-36116 (filed on Feb. 15, 1999);
Hei. 11-36117 (filed on Feb. 15, 1999);
Hei. 11-140924 (filed on May 21, 1999);
Hei. 11-147456 (filed on May 27, 1999); and
Hei. 11-256752 (filed on Sep. 10, 1999),
which are expressly incorporated herein by reference in their entireties.

BRIEF DESCRIPTION OF THE DRAWINGS

FIG. 8 is a schematic drawing to show one embodiment of setup range storage means of the recording apparatus.

BEST MODE FOR CARRYING OUT THE INVENTION

The invention will be discussed in detail based on embodiments shown in the accompanying drawings.

Figure 1:
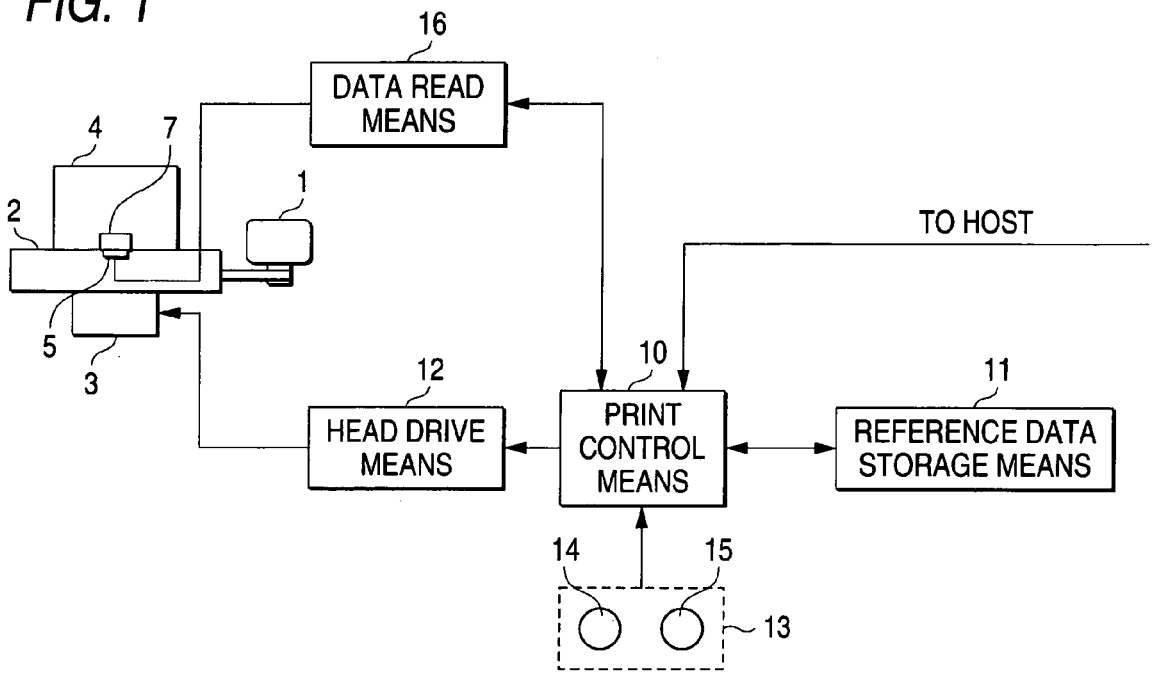
FIG. 1 is a block diagram to show a first embodiment of an ink jet recording apparatus of the invention.

FIG. 1 shows one embodiment of an ink jet recording apparatus of the invention. A recording head 3 is provided to the opposed side to record paper, of a carriage 2 reciprocated by a drive motor 1. An ink cartridge 4 for supplying ink to the recording head 3 is mounted detachably on the upper surface of the carriage 2.

Figure 2:
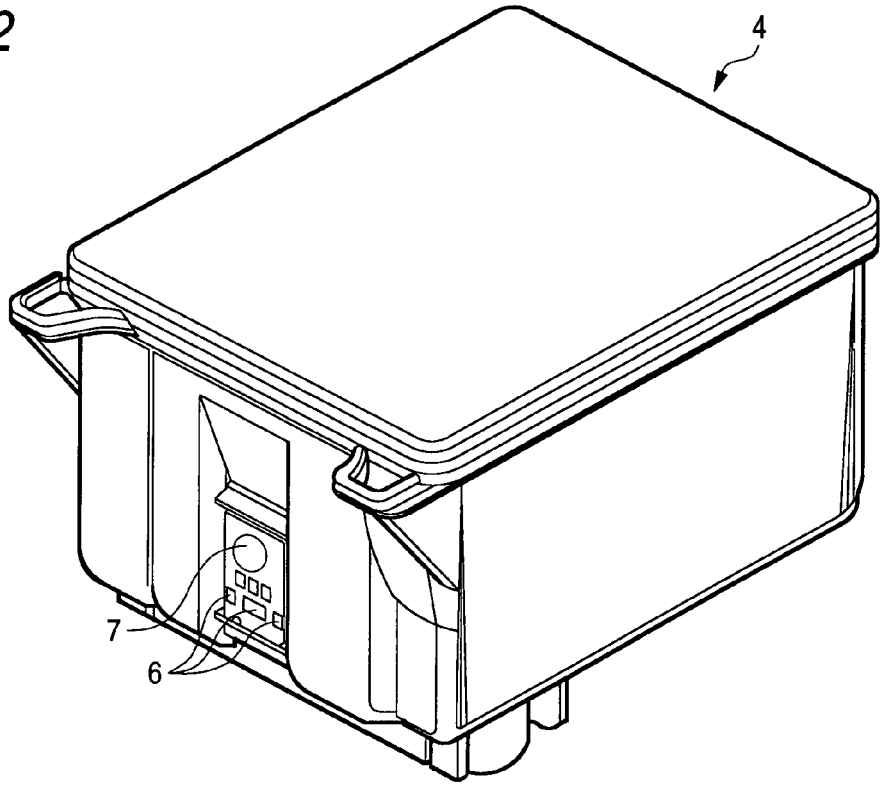
FIG. 2 is a drawing to show one embodiment of an ink cartridge.

Storage means 7 connected to electrodes 6 contactable with an external contact 5 is mounted to the ink cartridge 4 as shown in FIG. 2. It stores control data, etc., for driving the recording apparatus in optimum conditions in addition to (1) ID data for identifying ink cartridge
(2) manufacturing year/month/day
(3) expiration date
(4) data specifying compatible recording apparatuses
(5) ink capacity, etc.

Referring again to FIG. 1, print control means 10 is provided with reference data storage means 11 storing data of ink compatible to the recording apparatus, and compares the data stored in the reference data storage means 11 with the data read from the ink cartridge 4 to determine whether or not print can be executed. If compatible, the print control means 10 controls head drive means 12 under predetermined drive conditions to executing the print operation. If compatibility cannot be confirmed, the print control means 10 displays a caution on a panel 13 and a display of a host.

Figure 3:
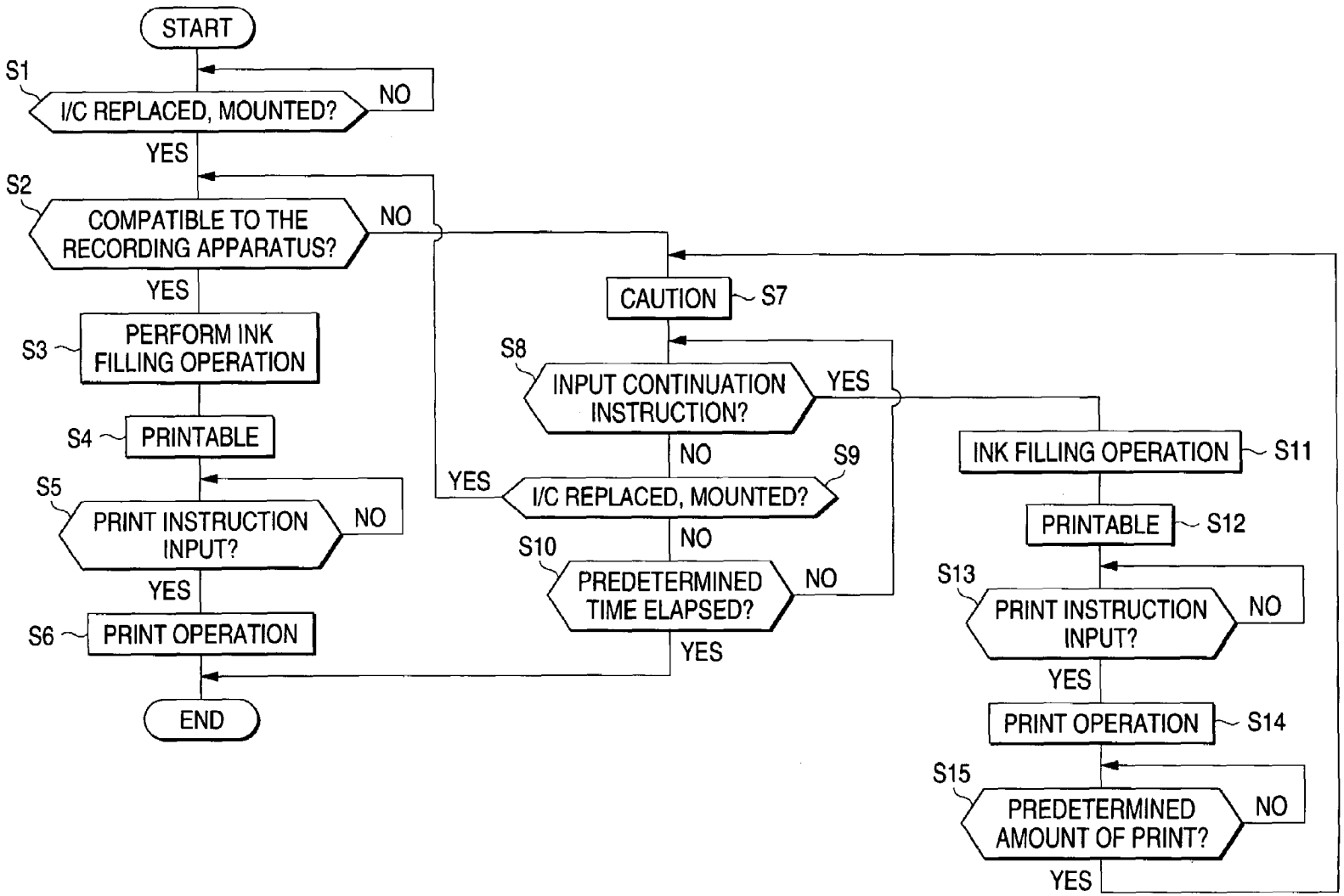
FIG. 3 is a flowchart to show the operation of the recording apparatus.

Next, the operation of the recording apparatus thus configured will be discussed based on a flowchart shown in FIG. 3.

When an ink cartridge replacement instruction is issued from an ink cartridge replacement switch 14 on the panel 13 or the host, the print control means 10 moves the carriage 4 to an ink cartridge replacement position.

In this state, if the ink cartridge 4 is mounted (step S1), the print control means 10 reads control data from the storage means 7 of the ink cartridge 4 through data read means 16, and determines whether or not data compatible to the recording apparatus is included (step S2). If compatible, the print control means 10 starts a sequence for filling the recording head 3 with ink to fill the recording head 3 with ink (step S3), and a printable state is established (step S4). If a print instruction is input in this state (step S5), the print operation is continued (step S6).

On the other hand, if compatibility to the recording apparatus cannot be confirmed (step S2), the print control means 10 generates an indication for prompting the user to replace or again confirm the ink cartridge on the panel 13 or the display of the host (step S7), and awaits a print continuation instruction to be input from a continuation instruction switch 15 on the panel (step S8) or an ink cartridge replacement instruction to be entered by the ink cartridge replacement switch 14 (step S9) for a predetermined time (step S10). If no operation is performed within the predetermined time, the subsequent operation is inhibited.

On the other hand, if the user's confirmation is given based on the caution, so that the print continuation instruction is output from the continuation instruction switch 15 on the panel 13 or the host within the predetermined time (step S8), then the recording head 3 is filled with ink in the mounted ink cartridge 4 (step S11) and printing is enabled (step S12). A print instruction is input (step S13), and printing is started (step S14), and when an amount of print appropriate for replacing the ink cartridge 4, for example, one-page print, is complete (step S15), the program returns to step (S7) to generate the indication for prompting the user to replace or again confirm the ink cartridge on the display of the panel 13 or the host, thereby preventing trouble caused by printing with ink whose compatibility cannot be confirmed, as much as possible.

Thus, whenever a predetermined amount of print is complete, the user is prompted to replace the ink cartridge 4. This remarkably reduces waste print sheets and serious damage of the recording head 3 due to the use of incompatible ink to avoid loss of the user, and permits a small amount of printing even if a compatible cartridge is not in hand, thereby eliminating the inconvenience of the unprintable state.

Figure 4:
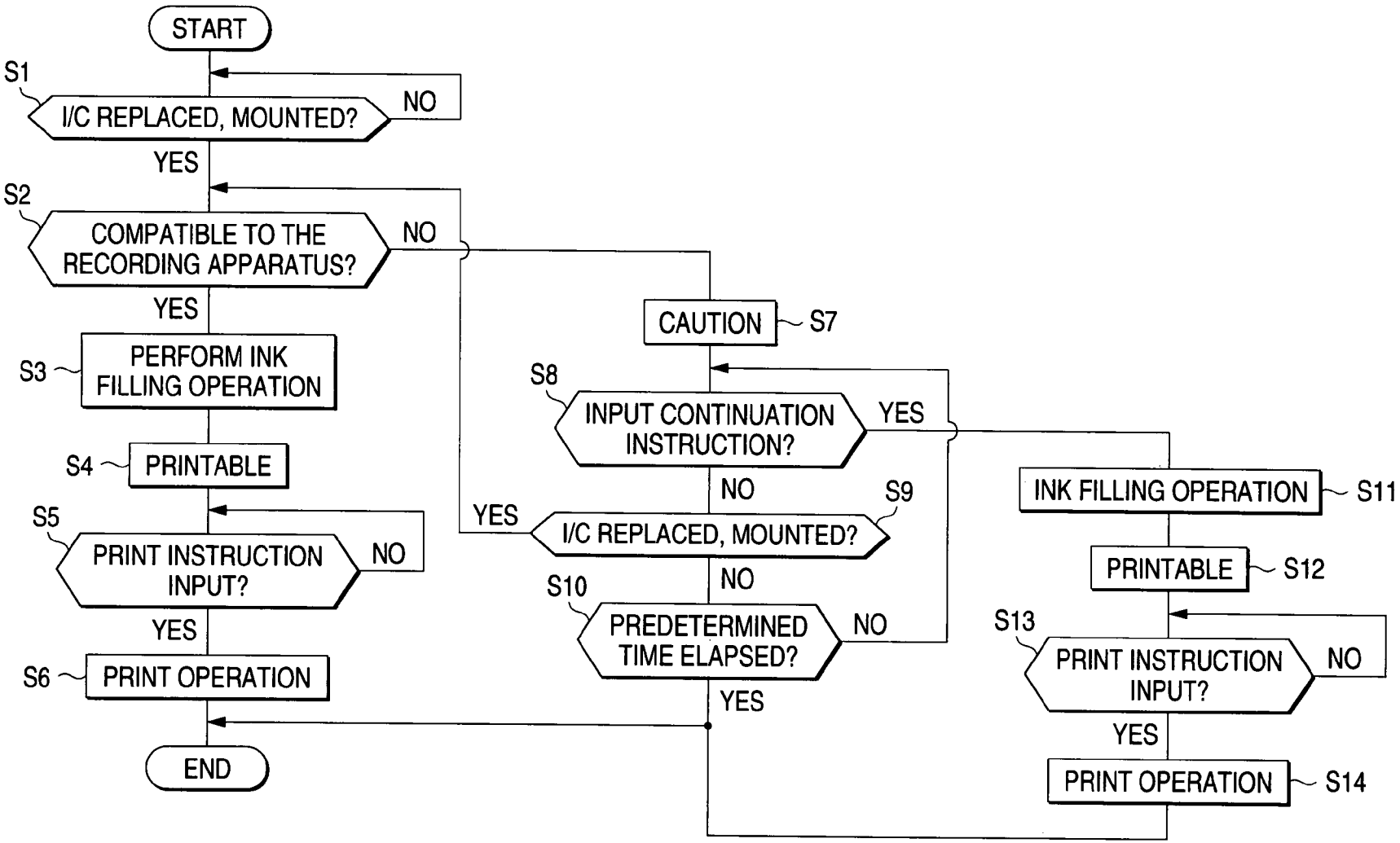
FIG. 4 is a flowchart to show another operation of the recording apparatus.

In the above-described embodiment, if a cartridge whose compatibility cannot be confirmed is mounted, the user is requested to confirm the cartridge each time a predetermined amount of print is complete, for the purpose of minimizing the damage. However, as shown in FIG. 4, the step (S15) in FIG. 3 may be omitted to provide such a simple protection that the caution is given only once and the subsequent operation is executed in a similar manner as if the compatibility is confirmed.

According to the above-described embodiment, when an ink cartridge is mounted, if compatibility to the ink cartridge cannot be confirmed, the caution is given, and the input of the continuation instruction by the user is awaited to execute the subsequent operation. Thus, the subsequent operation such as filling the recording head with ink can be executed based on user's confirmation if compatibility of the ink cartridge cannot be confirmed. Therefore, the recording head can be protected from the damage caused due to filling with improper ink, and waste print sheets can be prevented. Further, if the compatibility cannot be confirmed because of trouble of the recording apparatus side, a forcible transition to the print operation can be made and user's complaint can be solved.

Second Embodiment

Figure 5:
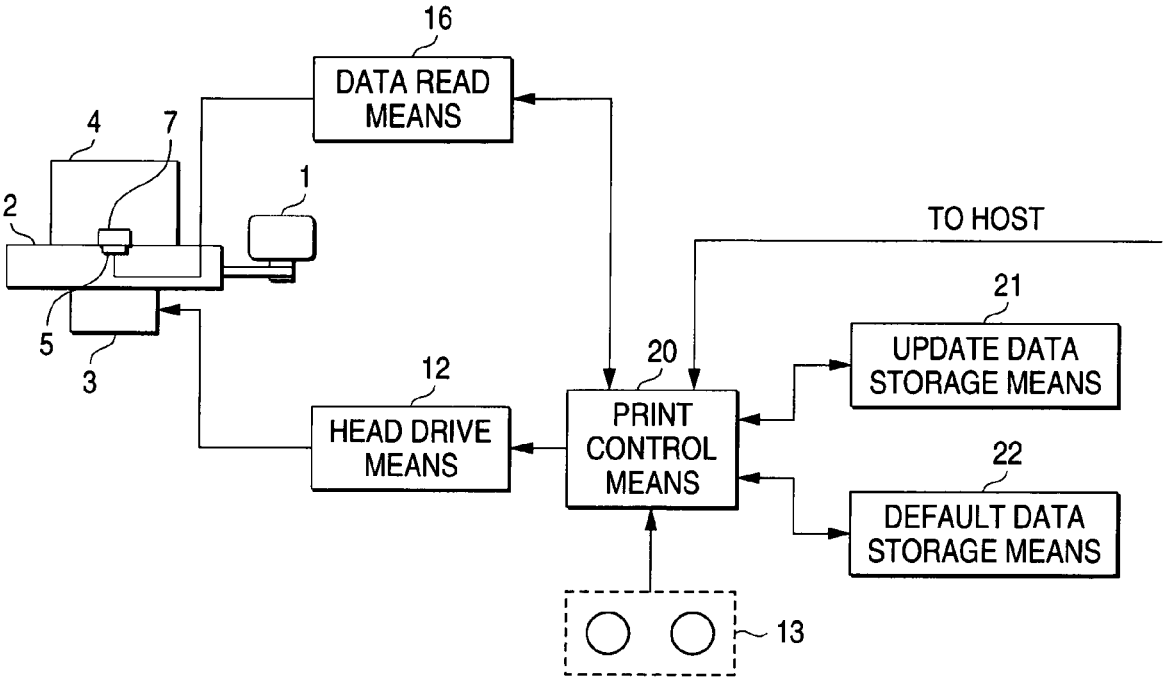
FIG. 5 is a block diagram to show a second embodiment of an ink jet recording apparatus of the invention.

FIG. 5 shows a second embodiment of an ink jet recording apparatus of the invention. Print control means 20 is accessible to update data storage means 21 storing data read from storage means 7 of an ink cartridge configured as described above, and default data storage means 22 storing default data for enabling the record operation to such an extent that printing can be executed regardless of whether or not data in the storage means 7 of the ink cartridge exists. The print control means 20 controls head drive means 12 based on either one of these data.

Figure 6:
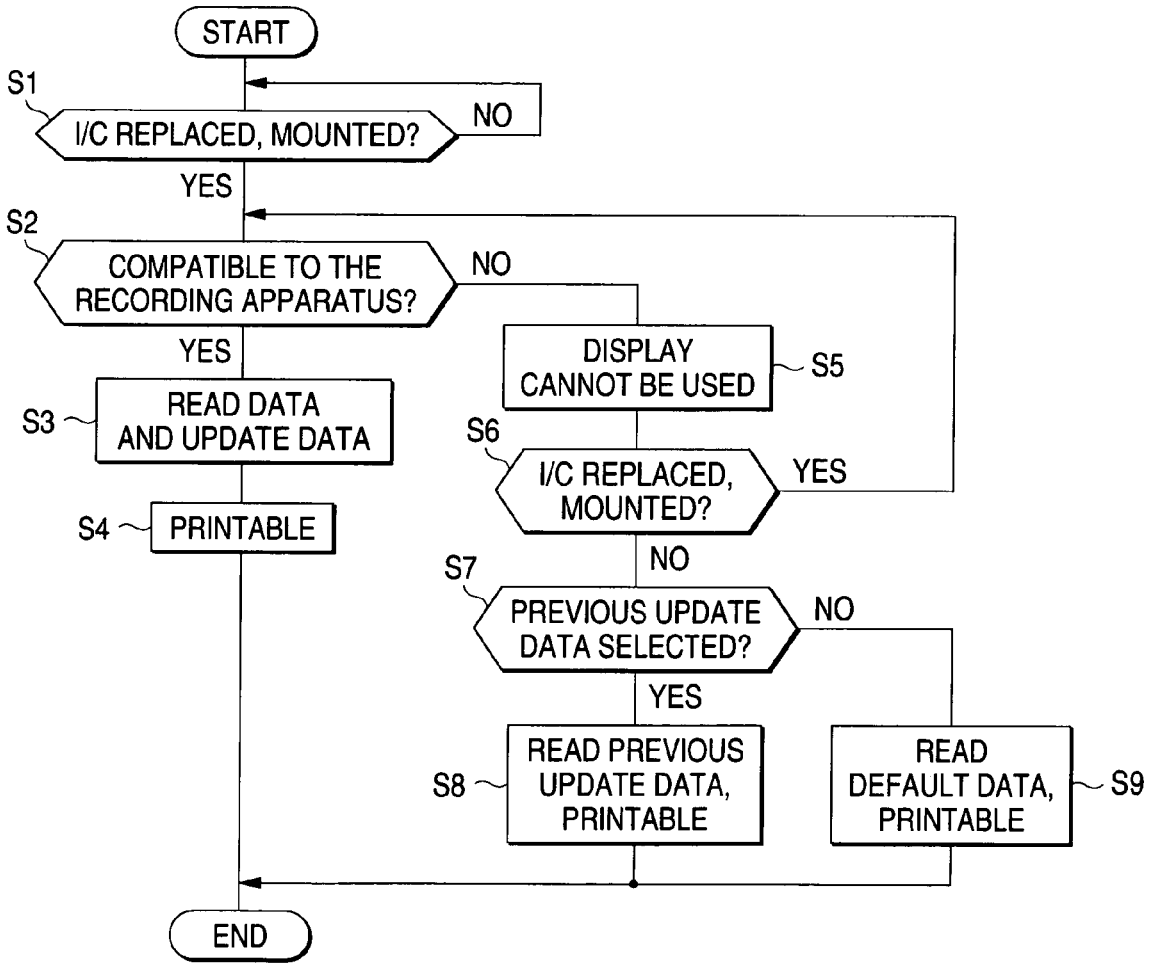
FIG. 6 is a flowchart to show the operation of the recording apparatus.

Next, the operation of the recording apparatus thus configured will be discussed based on a flowchart shown in FIG. 6.

When an ink cartridge 4 is mounted (step S1), the print control means 20 reads control data from the storage means 7 of the ink cartridge 4 through data read means 16, and determines whether or not data compatible to the recording apparatus is included (step S2). If compatible, the print control means 20 reads the data, and updates the data in the update data storage means 21 (step S3), and a printable state is established (step S4).

On one hand, if the data is incompatible to the recording apparatus or the data cannot be read, the print control means 20 produces an indication for prompting the user to replace the ink cartridge (step S5). If the ink cartridge is replaced based on the indication (S6), the program returns to step (S2) and the above-described steps are repeated.

On the other hand, if a new cartridge is not in hand and a instruction for printing with previous update data is given by an external switch 13 (step S7), the print control means 20 reads data stored in the update data storage means 21, provided that the data exists in the update data storage means 21, and a printable state is thus established (step S8).

If data does not exist in the update data storage means 21, the print control means 20 reads data from the default data storage means 22, and a printable state is established (step S9).

Thus, if data cannot be read from the storage means 7 although the ink cartridge is proper, the default data enables printing with reasonable quality. If the previous update data is stored, normal printing can be executed, provided that ink in the cartridge is compatible to the recording apparatus.

According to the embodiment, the recording apparatus includes the default data storage means storing the default data for controlling the recording head, and the print control means, which, when an ink cartridge is mounted, reads data from the storage means of the ink cartridge to determine compatibility, which controls the ink jet recording head based on the data in the storage means of the ink cartridge if compatible, and which executes the print operation based on the data in the default data storage means if incompatible. Therefore, in a case where data cannot be read from the semiconductor storage means of the ink cartridge although the ink cartridge is proper, the default data enables printing with reasonable quality and user's complaint can be solved.

Second Embodiment

Figure 7:
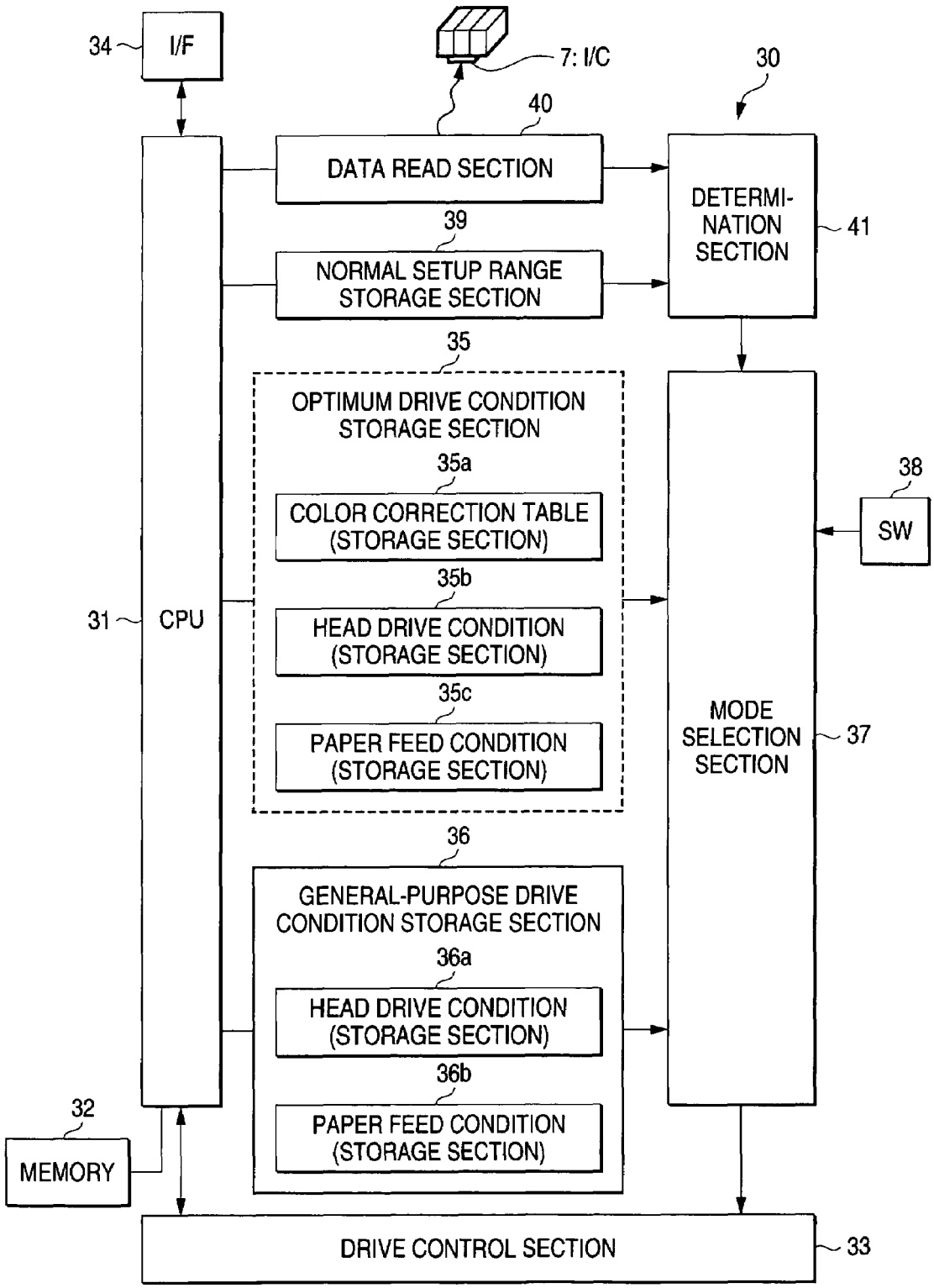
FIG. 7 is a block diagram to show a third embodiment of an ink jet recording apparatus of the invention.

FIG. 7 shows the main part for determining soundness of data in storage means attached to an ink cartridge.

A control mechanism 30 of a recording apparatus is constructed mainly of a microcomputer 31, a memory 32 for storing a control program and data, a drive control section 33 for controlling the print operation, and an interface 34 for receiving print data from a host device not shown.

It also includes optimum drive condition storage means 35 storing an optimum drive condition for a proper ink cartridge guaranteed for use with the recording apparatus, and general-purpose drive condition storage means 36 storing a general-purpose drive condition for making it possible to carry out print with safety even for any other ink cartridge than proper ink cartridges.

In the embodiment, the optimum drive condition storage means 35 includes a color correction table storage section 35*a*, a head drive condition storage section 35*b* storing the data defining a setup value of applied voltage for ejection, and a paper feed condition storage section 35*c* storing the data defining the transport time of paper for changing the time required for drying ink after print. Normally, the drive control section 33 is set to an optimum quality mode through a mode selection section 37 based on information from the optimum drive condition storage means 35 so that print data is printed in the optimum quality mode.

The general-purpose drive condition storage means 36 includes a head drive condition storage section 36*a* storing a print-possible condition with safety and with high quality as much as possible if any ink cartridge other than proper ink cartridges is mounted, in the embodiment, the data of applied voltage capable of reliably ejecting ink droplets even if the viscosity of ink is high, and a paper feed condition storage section 36*b* storing the data defining the prolonged transport time of paper so as to provide the time for making it possible to reliably dry the record medium after print even with ink having low drying speed.

The optimum quality mode based on the optimum drive condition from the optimum drive condition storage means 35 and the general-purpose quality mode based on the general-purpose drive condition from the general-purpose drive condition storage means 36 are changed through the mode selection section 37 for output to the drive control section 33, which then executes print in the selected quality mode.

In the embodiment, setup range storage means 39 is provided as means for checking data read by a data read section 40 from storage means 7.

The setup range storage means 39 stores normal setup range data for comparison, indicative of the range of values that ink information in the storage means 7 should fall within if the ink information in the storage means 7 is sound data without being destroyed. A determination section 41 compares one or more or all attention information pieces of the read ink information with the normal setup range data, and if the attention information is within the normal setup range, the determination section 41 determines that the optimum drive condition from the optimum drive condition storage means 35 is to be used for printing, and if the attention information is out of the normal setup range, the determination section 41 determines that the general-purpose drive condition from the general-purpose drive condition storage means 36 is to be used for printing.

The ink information stored in the storage means 7 of an ink cartridge 4 has a data format fixed. The ink information in the storage means 7 is read serially, and the contents of the series of the information is checked sequentially from the beginning of the information. At the time, if a value that cannot exist originally is detected, it is determined that the storage contents of the storage means 7 are destroyed, and the print operation is executed in the preset general-purpose quality mode.

That is, the data item order and the number of assigned bytes are fixed, and when the ink information is read out by the recording apparatus side, the data values of the ink information are checked, whereby whether or not the data contents of the ink information are destroyed is checked. The determination section 41 compares all ink information read from the storage means 7 with the normal setup range data, and if the ink information falls within the normal setup range, the determination section 41 determines that the optimum drive condition is to be used for printing, and if even one piece of the ink information is out of the normal setup range, the determination section 41 determines that the general-purpose drive condition is to be used for printing.

FIG. 8 schematically shows one embodiment of the setup range storage means 39. The items in a data table correspond to plural types of information concerning ink (ink information) stored in the storage means 7. The eight items in the first half, i.e. the first to eighth items, are essential technical information which may be required for change between the optimum drive conditions and the general-purpose drive conditions. The subsequent four items, i.e. the ninth to twelfth items, are additional information not necessarily required for determination to change the drive conditions. The digits enclosed in parentheses denote the number of bits indicating the data length required for providing the corresponding information.

Here, the essential technical information is formed by manufacturing year (four bits), manufacturing month (four bits), manufacturing day (eight bits), attachment year (four bits), attachment month (four bits), attachment day (eight bits), ink type (four bits), and coloring matter (color information) (eight bits). The "ink type" indicates the type such as fast dried ink, low blurred ink, high light resistance ink, or pigment ink. Since they differ in physical characteristics of viscosity, specific gravity, etc., to jet, it is necessary to drive the head matching the type in order to eject the same amount of liquid droplet. Since the dry time after print varies depending on the ink type, unless a proper paper feed rate is selected, undried ink on the print surface is scrubbed, and dirt occurs.

The "coloring matter" indicates color configuration such as single color of black, three colors of YMC (yellow, magenta, cyan), monochrome multi-gradation, six colors of pale YMC family, or six colors of orange green color family, and an optimum color correction table is selected correspondingly to the color configuration. At the time, if an erroneous color correction table is used, good image quality cannot be obtained. The "ink type" and the "coloring matter" are particularly important elements among the essential technical information for the reasons described above.

The manufacturing year, month, and day and the attachment year, month, and day are considered as the essential technical information because printing with high quality can be executed by driving the head in association with time-related change of ink (viscosity is raised or color is changed because of degradation of degassed rate, thermal precipitation of foreign substance, or any other deterioration).

In the embodiment, four bits are assigned to the ink type assuming ten and several types, eight bits are assigned to the coloring matter considering the flexibility of setting, four bits are assigned to year for indication of low-order one digit of year, and four bits and eight bits are assigned to month and day respectively; however, if any other value is adopted as the number of bits, no problem is involved.

In the embodiment, the additional information includes data indicating the cartridge type of the destination, content amount, etc., of the cartridge (eight bits), information indicating the mode of the optimum ink sequence (eight bits), ink remaining amount (142 bits), and information indicating the manufacturing line (four bits). The reason why the number of bits assigned to the ink remaining amount is large is that it is necessary to set multiple stages from a no-ink state to an ink-full state.

Figure 9:
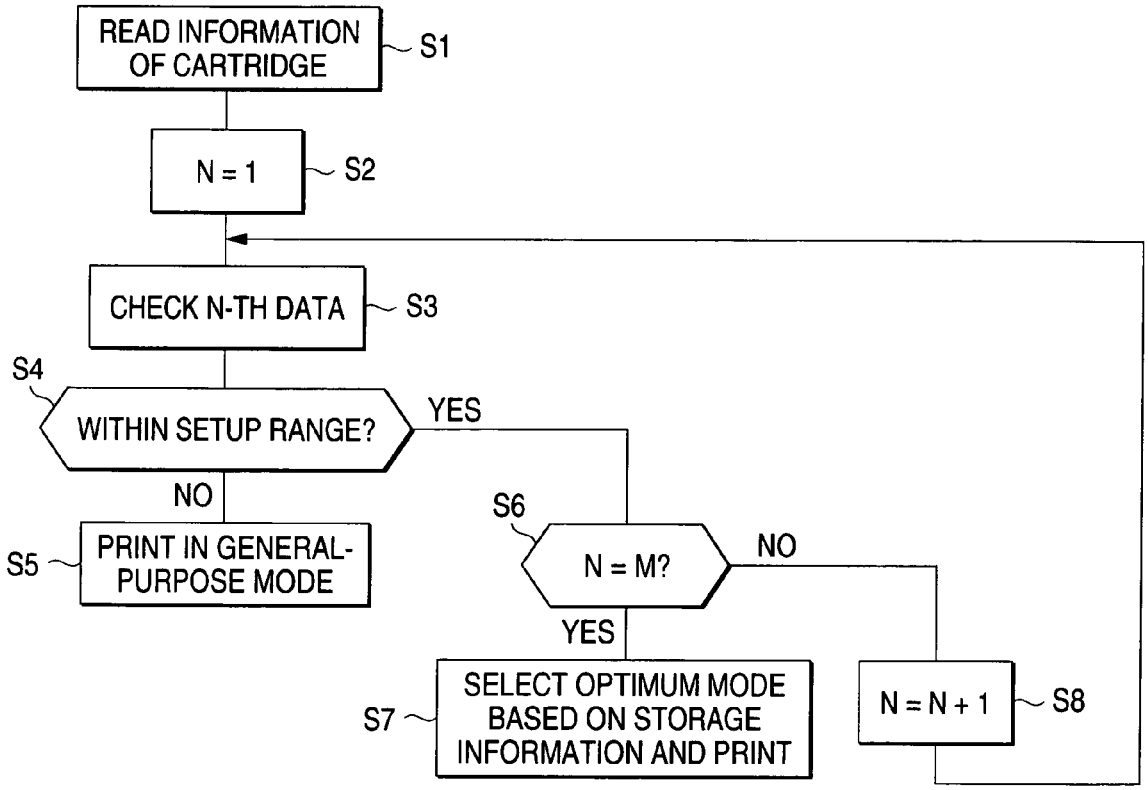
FIG. 9 is a flowchart to show the determination operation of the recording apparatus.

In FIG. 9, the determination section 41 compares ink information (m types) read serially from the storage means 7 by the data read section 40 with the normal setup range data in sequence through a format filter (steps S1 to S3). That is, check is started at the $N=1^{st}$ ink information, and if the ink information lies within the normal setup range stored in the normal setup range storage means 39, the program passes through steps (S4) and (6), increments N by one (N=N+1), and then returns to step (S3), so that the second ink information is checked in a similar manner. This process is repeated, and if all compared ink information (m types) lies within the normal setup range stored in the normal setup range storage means 39, it is determined that the state is the normal state in which the contents of the storage means 7 are not destroyed, and when N is identical to m (N=m) (step S6), the determination result is output to the mode selection section 37 for printing using the optimum drive conditions from the optimum drive condition storage means 35 (step S7).

However, if even one piece of all compared ink information (m types) is found to be out of the normal setup range in the check at step (S4), it is determined that the contents of the storage means 7 are destroyed by static electricity, etc., and printing is executed using the above-mentioned general-purpose drive conditions (step S5). However, printing can also executed using the above-mentioned general-purpose drive conditions only if the data about specific attention information, for example, the items of the ink type and the color information is out of the normal setup range.

Figure 10:
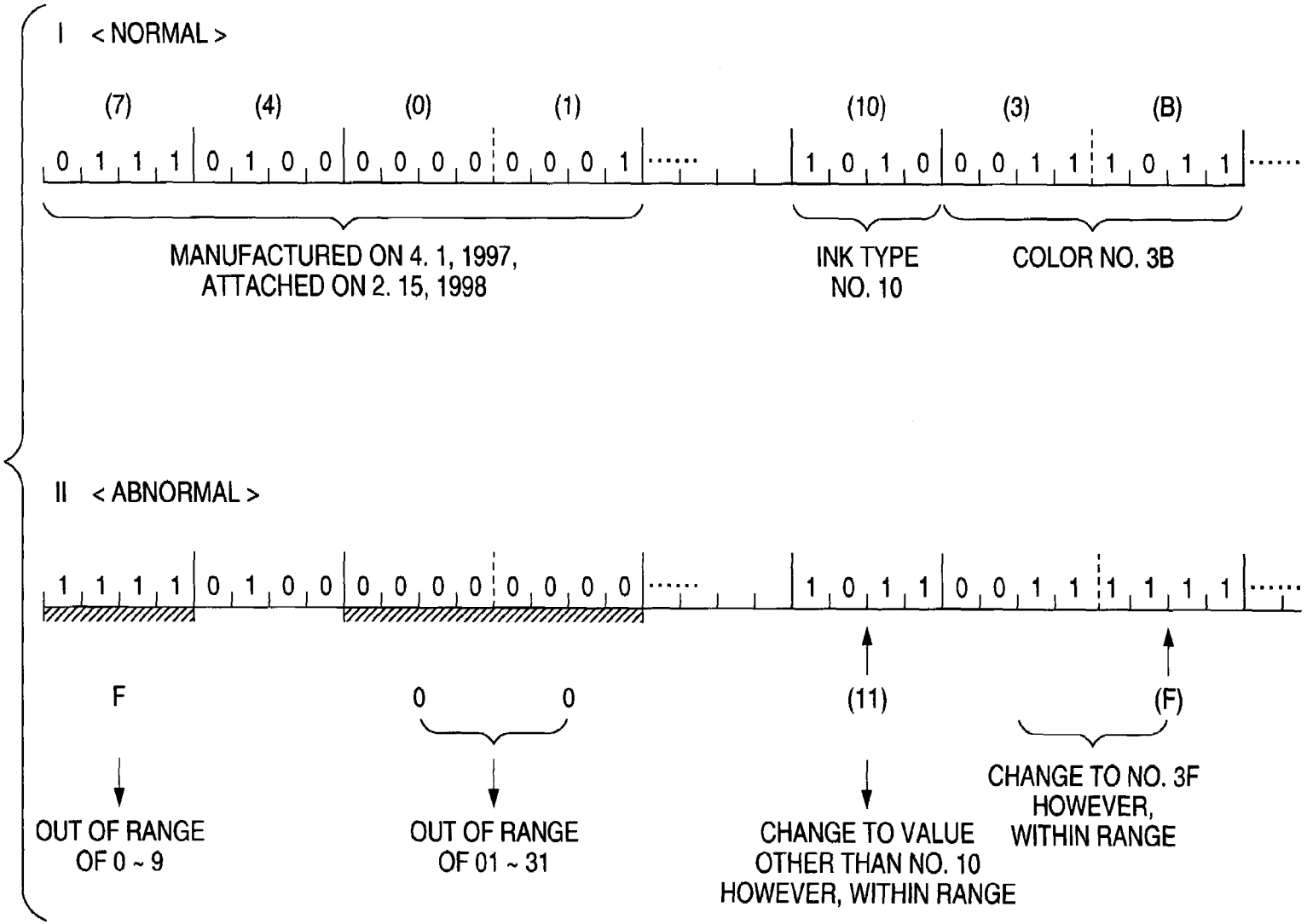
FIG. 10 is a drawing to show a format applied when ink information stored in storage means is normal and a format applied when ink information is abnormal.

The determination method will be further discusses based on FIG. 10. FIG. 10(I) shows the case where ink information in the format is "normal." It is assumed that the cartridge with ink type data No. 10 and color identification data No. 3B was manufactured on Apr. 1, 1997, and attached to the recording apparatus on Jul. 15, 1998.

FIG. 10(II) shows an "abnormal state" in which the ink information is destroyed or changed by overwriting due to the affect of static electricity, etc. That is, the contents of the first four bits (representation portion of 1997) in the portion representing manufacture date of Apr. 1, 1997 are changed from original "7" to "F." Further, the contents of the manufacturing day represented on the third and fourth four bits are also changed from original "01" to "00." The data at locations where ink type data No. 10 and color identification data No. 3B should occur is changed from original "10" and "3B" to "11" and "3F." Their normal setup ranges are "0 to 9" for the manufacturing year and "01 to 31" for the manufacturing day. For the ink type, "11" as well as "10" in "0 to F" is contained in the setup range, and for the color information, "3F" as well as "3B" in "00 to FF" is contained in the setup range.

First, the microcomputer 31 reads ink information serially from the storage means 7 of the cartridge 4, and checks the first item (manufacturing year) to see if the ink information lies within the normal setup range. The manufacturing year is changed from original "7" to "F", and "F" exceeds the normal setup range of the upper limit value to the lower limit value, "0 to 9," thus the determination section 41 determines that the data in the storage means 7 is destroyed because of static electricity, etc., as it is 'out of range'. Accordingly, printing is executed using the general-purpose drive conditions.

If determination control is performed, there is no problem. However, for example, assuming that the manufacturing year data and the manufacturing day data fall within the setup ranges in FIG. 10, even if the overwriting as shown in FIG. 10 is contained in the ink type data and the color information data, the overwriting of the data (which is also data destruction) cannot be detected at all.

Even in such a case, if the additional information shown in FIG. 8 (Nos. 9 to 12) are stored in the storage means 7, the additional information parts are also affected by the fact that the ink type and the color information are destroyed or overwritten, thus the possibility that they will be out of the setup range is very high.

In other words, it can be found to be a very rare case that only the ink type and the color information will be replaced and destroyed and any other information will not be destroyed at all although there is the cause of data destruction. Therefore, it is made possible to estimate occurrence of data destruction as mentioned above that cannot apparently be detected on the ink type or the color information, on the basis of destruction of the additional information. In such a case, change can be made to the general-purpose drive conditions for executing print in reliable drive conditions.

Alternatively, the general-purpose mode is set so that it is executed only when checking all ink information is complete, and if the number or the ratio of the ink information pieces whose values do not fall within the normal setup range among all ink information (m types) exceeds a given value, print may be executed using the general-purpose drive conditions.

It is desirable to change the print conditions so that the increase degree of ink droplet ejection output and the lowering degree of the paper feed rate are made larger as the number or ratio of the pieces whose values do not fall within the normal setup range among a plurality of ink information pieces (m types) is increased, namely, to change the print conditions at multiple stages in accordance with the degree of incompatibility.

As described above, according to the embodiment, printable drive conditions can be selected for printing even in a case where the ink information stored in the storage means is destroyed or a case where an ink cartridge, which is not originally provided with storage means and thus the compatibility of which cannot be confirmed, is mounted.

Fourth Embodiment

By the way, ink is improved for still more improvement of the print quality, and plural types of ink cartridges are to be prepared for the same recording apparatus. That is, the ink jet recording apparatus can also print with high quality on a display film and coated paper as well as ordinary paper by exchanging ink, but options of ink cartridges and media are increased and it becomes difficult for an unfamiliar user to buy the target product properly; this is a problem.

Figure 11:
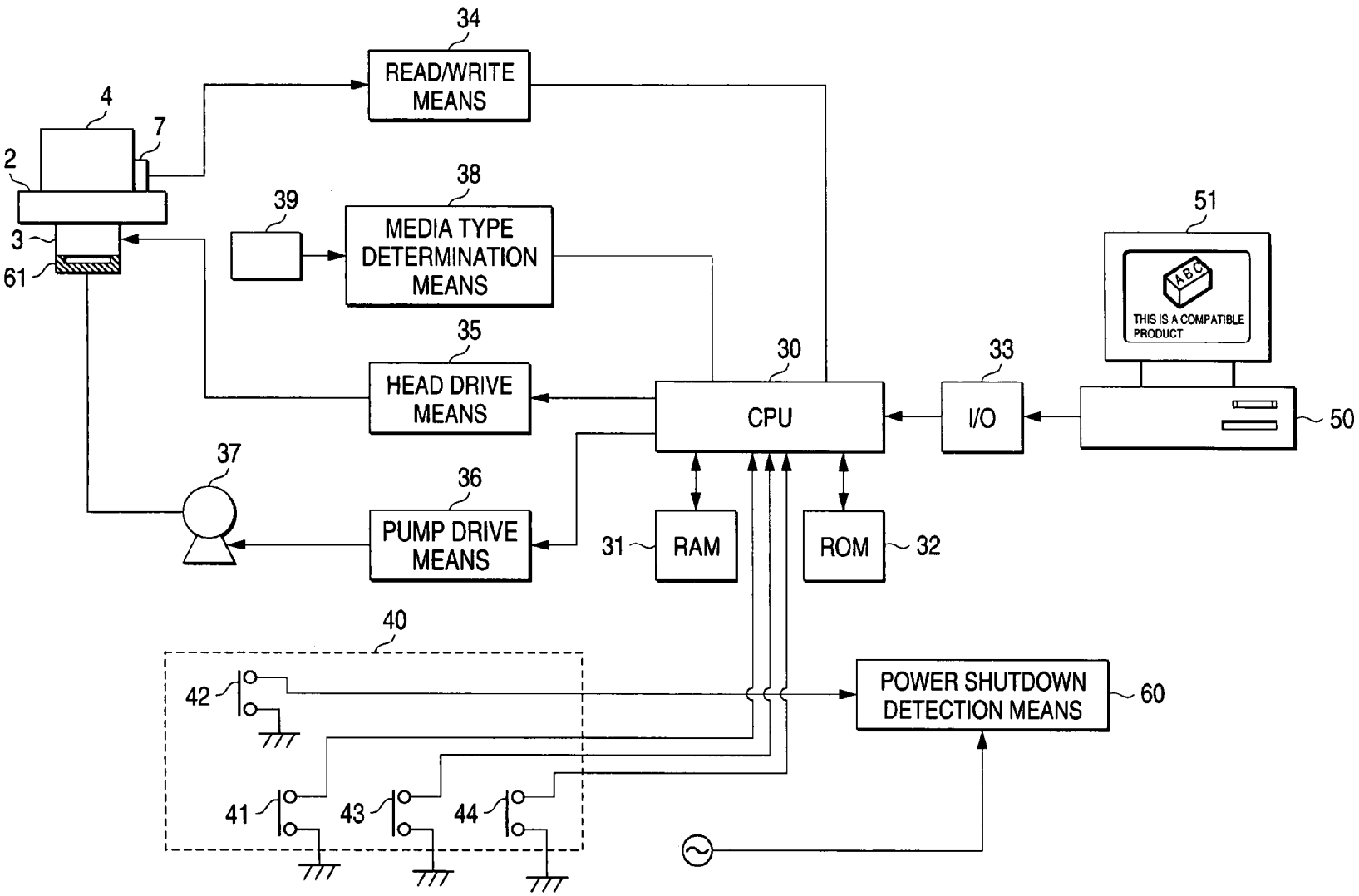
FIG. 11 is a block diagram to show a fourth embodiment of the invention.

FIG. 11 shows an embodiment of an ink jet recording apparatus, to deal with such a problem. When an incompatible ink cartridge is mounted, the recording apparatus can prevent a recording head from being filled with incompatible ink as much as possible and assist the user in selecting a proper ink cartridge to prompt the mounting of the compatible ink cartridge. When an ink cartridge incompatible to a record medium is mounted, the recording apparatus can assist, prior to the filling of the recording head with incompatible ink, the user to appropriately select an ink cartridge and a medium that are suitable for the user's print form among various ink cartridges. In this manner, the recording apparatus enables printing in the optimum state.

In FIG. 11, a CPU 30, RAM 31, and ROM 32 make up a microcomputer which is connected via an interface 33 to a host 50. The RAM 31 functions as work memory of the CPU 30, and has an area for temporarily storing data read by read/write means 34 from storage means 7 of an ink cartridge 4, and the ROM 32 stores a control program.

The recording apparatus thus configured outputs a drive signal to a recording head 3 by head drive means 35 based on print data from the host 50 for ejecting ink droplets, and when an operation instruction of ink droplet ejection recovery is given by operating a cleaning instruction switch 41, etc., provided on an operation panel 40 of the recording apparatus, the recording apparatus causes pump drive means 36 to actuate a pump unit 37 for forcibly discharging ink from the recording head 3. The amounts of ink used for the printing and cleaning are calculated by the microcomputer, and stored in the ROM 32.

Media type determination means 38 determines the type of print medium, namely, ordinary paper, film, or coated paper based on a signal from a sensor 39, and outputs the determination result to the CPU 30. Such medium determination can be easily made by detecting a reflection rate of the record medium or previously printing data specifying the type of medium in a non-print area on the back or at a corner of the medium in a sensor-readable format.

In the figure, numeral 60 denotes power shutdown means for supplying power until termination processing of the recording apparatus is completed subsequently to the operation of a power switch on the operation panel 40, and then shutting down the commercial power supply.

Figure 12:
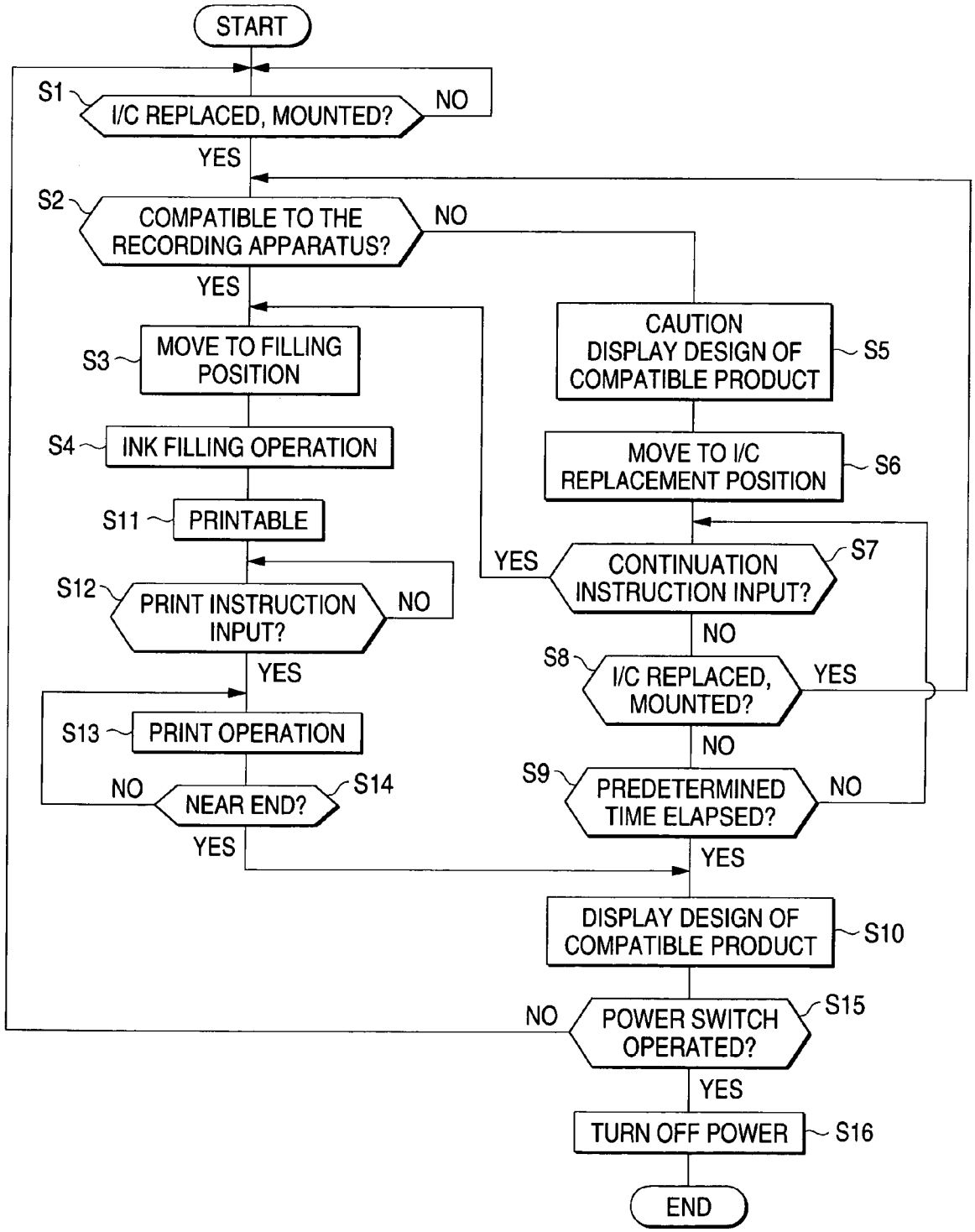
FIGS. 12 and 13 are flowcharts to show the operation of the recording apparatus.

Next, the operation of the recording apparatus thus configured will be discussed based on a flowchart shown in FIG. 12.

As known, the recording apparatus is connected to the host 50 by a cable, and is controlled by driver software previously installed in the host 50 for driving the recording apparatus.

In this state, to replace the ink cartridge 4, the driver software is started, an ink cartridge replacement menu is displayed, and an ink cartridge replacement instruction is given or a cartridge replacement instruction switch 43 on the operation panel 40 is operated.

Thus, a replacement instruction signal is output and the microcomputer 30 performs predetermined processing, namely, moves a carriage 2 to the ink cartridge replacement position and when the ink cartridge is replaced (step S1), reads data from the storage means 7 of the ink cartridge 4 through the read/write means 34 and determines whether or not the data is compatible to the recording apparatus (step S2). If the data is compatible, the microcomputer 30 moves the carriage 2 to the filling position (step S3) and seals the recording head 3 with a capping unit 61, then actuates the pump unit 37 for filling the recording head 3 with ink (step S4).

According to the operation, bubbles entering the recording head 3 inevitably at the attachment and detachment when the ink cartridge 4 is replaced can be reliably discharged in order to ensure the quality of the subsequent printing, and if the ink cartridge 4 is replaced with an ink cartridge different in ink type, the different type of ink can be reliably discharged for preventing a print failure.

On the other hand, if compatibility of the ink cartridge cannot be confirmed, the microcomputer outputs a signal to an unillustrated display on the operation panel of the recording apparatus or the host 50 to produce, on a display 51 of the host 50, an indication, such as an indication of prompting the user to confirm the ink cartridge and an indication of a packing design of a compatible ink cartridge (step S5), and moves the carriage 2 to a position at which the ink cartridge can be replaced (step S6).

The indicated data may be the model name or the type name of the ink cartridge, and further if the packing design, the model name, and the type name of the compatible ink cartridge are displayed in association with each print purpose, appropriate information can be provided for the user. The contact addresses and telephone numbers of the dealers of the ink cartridges can also be displayed as required. Thus, even an unfamiliar user can reference the display when buying an ink cartridge, and can surely buy a compatible product without buying any erroneous ink cartridge.

A caution is thus given before the recording head 3 is filled with ink of the ink cartridge 4 mounted. Ink different in type can be prevented from flowing into the recording head 3 to destroying the recording head 3 and degrade the print quality.

If the ink cartridge 4 is replaced without operating a continuation instruction switch 44 (step S8), the program jumps to the above-described step (S2) to conduct the above-described determination.

On the other hand, if the continuation instruction switch 44 on the operation panel 40 is pressed though such a caution is given (step S7), the carriage 2 is moved to the filling position (step S3) and the recording head 3 is sealed with the capping unit 61, then the ink filling operation is performed in a similar manner to that when the compatible ink cartridge 4 is mounted (step S4).

If a predetermined time has elapsed (step S9) without replacing the ink cartridge 4 after the caution is given at step (S5), information useful for specifying a compatible ink cartridge, such as design put on a package of the ink cartridge 4 compatible to the recording apparatus and further the current record medium, is displayed on the display 51 of the host 50 (step S10). Thus, even an unfamiliar user can reference this display when buying an ink cartridge, and can surely buy a compatible product without buying any erroneous ink cartridge as the ink cartridge 4.

In this manner, a printable state is established (step 11), and when a print instruction is input from the host 50 (step S12), the microcomputer 30 drives the recording head 3 by the head drive means 35 to eject ink droplets, thereby executing the print operation (step S13).

The ink consumed by the printing is managed by counting the drive signals output from the head drive means 35.

If the ink droplet ejection capability is lowered during the print operation, etc., the carriage 2 is moved, the recording head is sealed with the capping unit 61, and the pump unit 37 is actuated for forcibly discharging ink from the recording head 3 to eliminate clogging in nozzle openings, and concurrently, the amount of ink discharged at this operation is managed as the drive time of the pump unit 37, etc.

When the ink consumption amount after the attachment of the ink cartridge 4 is reduced to the near end, namely, down to the ink amount just before the recording head 3 becomes empty of ink (step S14), a signal is output to the host 50 for displaying the ink end on the display 51 of the host 50 to prompt the user to replace the ink cartridge. If the near end caution is overlooked and ink is consumed entirely, the printing is forcibly stopped and an indication of requesting the user to replace the ink cartridge is displayed.

At the same time, useful information for specifying a compatible ink cartridge, such as design put on the package of the ink cartridge compatible to the recording apparatus, is displayed on the display 51 of the host 50 (step S10). Thus, even an unfamiliar user can reference the display when buying an ink cartridge and can surely buy a fitted product without buying any erroneous ink cartridge.

When a power off instruction is given by operating the power switch 42 (step S15), the data in the RAM 31 concerning the ink cartridge is saved in the ROM 32, and upon completion of termination processing, the power is shut down (step S16).

Figure 13:
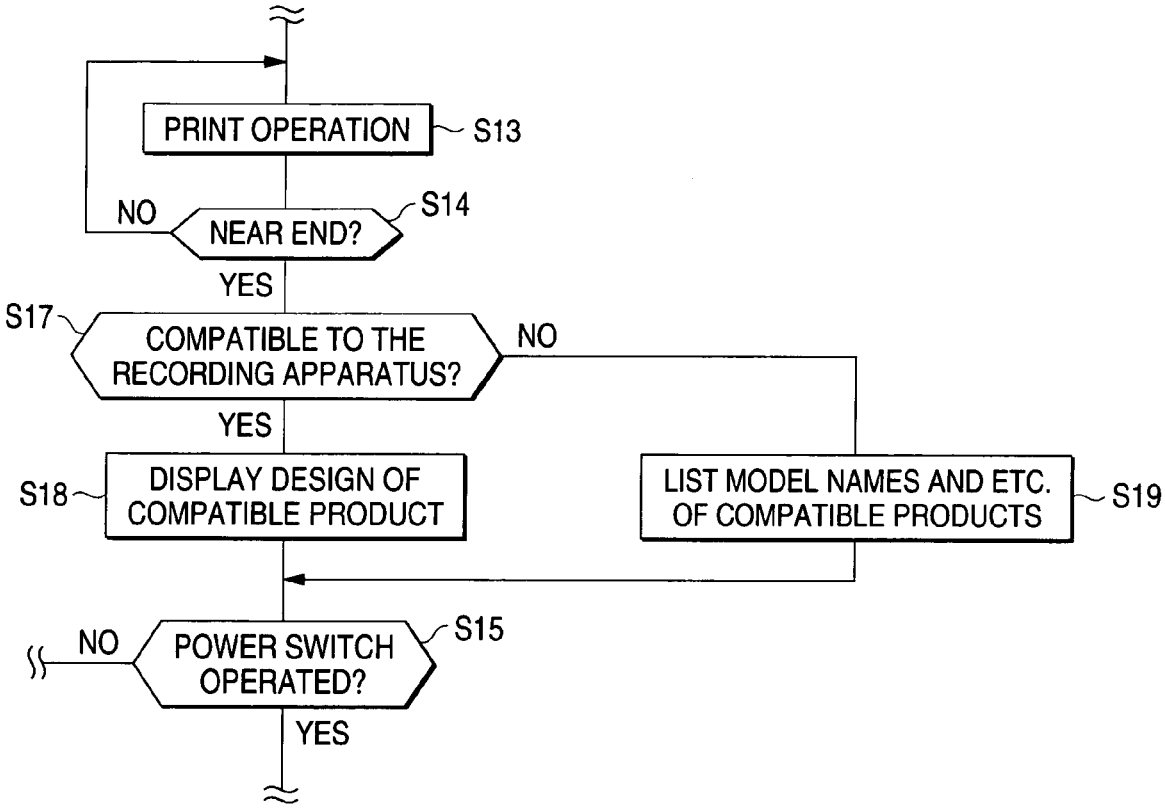

In the above-described embodiment, when the ink cartridge 4 becomes the near end or the ink end (step S14), the design and the type name of the compatible product are displayed (step S10). As shown in FIG. 13, when the ink cartridge 4 becomes the near end or the ink end (step S14), whether or not the currently mounted ink cartridge 4 is compatible is determined (step S17), and if it is a compatible product, the design of the current mounted, compatible ink cartridge is displayed similarly to the above-described embodiment, and if not a compatible product, a list of the type names and the model names of a plurality of ink cartridges compatible to the recording apparatus is displayed (step S19), and the operation of the power switch 42 is awaited (step S15).

As described above, if a compatible product is mounted, selection of the ink cartridge that can ensure the same print quality continuously is facilitated. If an incompatible product is mounted, a list is displayed, indicating the type names and the model names of a plurality of ink cartridges compatible to the recording apparatus in order to propose all ink cartridges compatible to the recording apparatus to the user, and assist the user to select an ink cartridge appropriate for the user's needs.

By the way, the print quality of the printed matter provided by the ink jet recording apparatus depends largely on the state of blur and penetration of ink droplets on the record medium surface, thus a record medium is selected in accordance with the purpose and use of print, and further ink optimum for each record medium is provided. Thus, the user unfamiliar with handling is hard to determine whether or not a record medium and an ink cartridge are compatible to each other.

Figure 14:
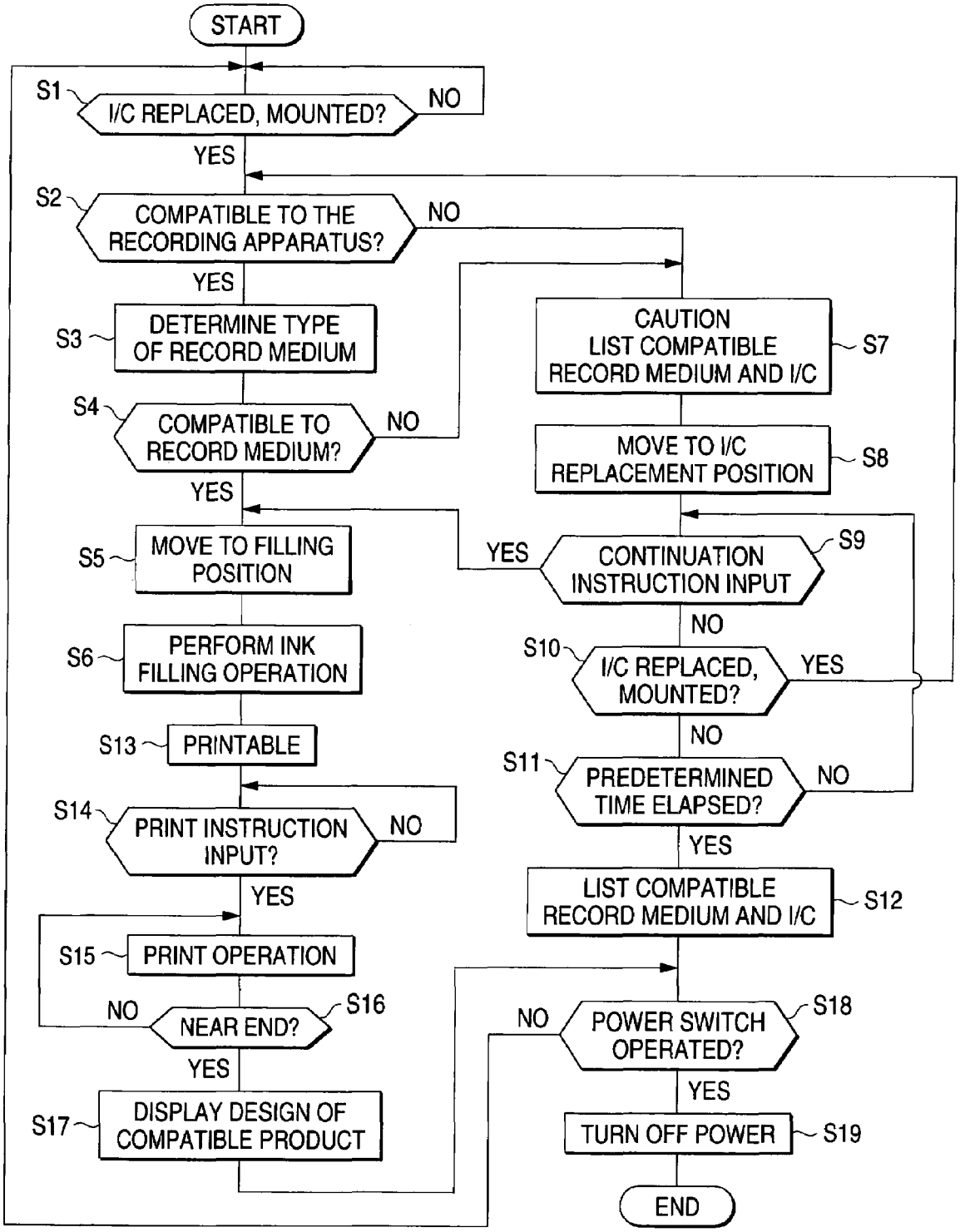
FIG. 14 is a flowchart to show the operation for determining compatibility of ink cartridge in association with media by the recording apparatus.

FIG. 14 is a flowchart to show one embodiment which also determines whether or not a record medium and an ink cartridge are compatible to each other in order to assist the user in buying the ink cartridge and the record medium optimum for the user.

When the ink cartridge 4 is replaced (step S1), data is read from the storage means 7 of the ink cartridge 4 through the read/write means 34 and whether or not the data is compatible to the recording apparatus is determined (step S2). If the ink cartridge is compatible to the recording apparatus, the media type determination means 38 determines the type of record medium (step S3). If the mounted ink cartridge 4 is compatible to the record medium (step S4), the carriage 2 is moved and the recording head 3 is sealed with the capping unit 61 (step 5) and the pump unit 37 is operated for filling the recording head 3 with ink (step S6).

On the other hand, if compatibility of the ink cartridge to the recording apparatus or the record medium cannot be confirmed, the microcomputer 30 displays a caution for prompting the user to confirm the ink cartridge 4 and a list indicating compatible combinations of record papers and ink cartridges (step S7), and moves the carriage 2 to a position at which the ink cartridge 4 can be replaced (step S8). The data to be displayed may be not only the list, but also the packing designs of the ink cartridges and record papers. The data of the optimum combinations of the ink cartridges and record media is stored in the storage means 7 of the ink cartridge or the ROM 32.

If the ink cartridge 4 is replaced without operating the continuation instruction switch 44 (step S10), the program jumps to the above-described step (S2) to execute the above-described determination operation.

On the other hand, if the continuation instruction switch 44 on the operation panel 40 is pressed through such a caution is given (step S9), the carriage 2 is moved to the filling position (step 5) and the ink filling operation is performed in a similar manner to that performed when a compatible ink cartridge 4 is mounted (step S6).

If a predetermined time has elapsed (step S1) without replacing the ink cartridge 4 after the caution is given at step (S7), the indication similar to that at the above-described step (S7) is displayed (step S12) for the assisting purpose in order to prevent erroneous purchase of an incompatible combination of record medium and ink cartridge.

As described above, a printable state is established (step S13), and when a print instruction is input (step S14), the print operation is executed (step S15).

When the ink amount consumed after the attachment of the ink cartridge 4 reaches the near end or the ink end, a signal is output to the host 50 to prompt the user to replace the ink cartridge, and concurrently, to display useful information for specifying a compatible ink cartridge, such as design put on the package of the ink cartridge compatible to the recording apparatus (step S17). Thus, the user can surely buy an ink cartridge compatible to the record medium.

When a power off instruction is given by operating the power switch 42 (step S18), the data in the RAM 31 concerning the ink cartridge 4 is saved in the ROM 32, and upon completion of termination processing, the power is shut down (step S19).

According to the embodiment, an ink cartridge compatible to not only the recording apparatus but also the record medium to be printed by the recording apparatus can be bought without error.

In the above-described embodiment, the media determination means 38 detects the type of record medium based on the signal from the sensor 39, but it is clear that similar advantages are provided if the medium type is selected or specified by a switch on the recording apparatus or the host.

In the above-described embodiment, information on compatible ink cartridges and media is displayed on the display 51 connected to the host 50 and the display of the recording apparatus, but the information can also be printed out as a hard copy just before the ink end is reached as required.

As described above, according to the embodiment, if an ink cartridge whose compatibility to the recording apparatus cannot be confirmed is mounted, print is enabled, but the packing designs, etc., of the compatible products can be displayed on the display before the ink head is filled with ink. This prevents trouble caused by filling with incompatible ink as much as possible and assists an unfamiliar user to purchase an optimum ink cartridge. The user can mount a proper ink cartridge to the recording apparatus to operate the recording apparatus with full performance intended thereto.

The four embodiments have been described by taking the recording apparatus of the type in which an ink cartridge is mounted on the carriage as an example, but it is clear that similar advantages are obtained if the invention is applied to a recording apparatus in which an ink cartridge is housed in a cabinet and ink therein is supplied to a recording head of a carriage through an ink supply tube.

INDUSTRIAL APPLICABILITY

As described above, the recording apparatus of the invention enables printing as much as possible in a state in which compatibility of the ink cartridge cannot be confirmed. This eliminates user's inconvenience, and positively assists the user to prevent damage of the recording apparatus and operate the recording apparatus with the performance intended thereto.

What is claimed is:

1. An ink jet recording apparatus comprising:

an ink jet recording head for receiving supply of ink from an ink cartridge provided with storage means storing data for determining compatibility of a recording apparatus; and control means for determining compatibility of ink based on the data in the storage means and executing print operation, wherein said control means determines:

if compatibility to an ink cartridge cannot be confirmed when the ink cartridge is mounted, the recording apparatus generates a caution and awaits input of one of a continuation instruction and a cartridge replacement instruction by a user before the recording apparatus executes a subsequent print operation, and if the recording apparatus executes the subsequent print operation upon input of the continuation instruction by the user, the recording apparatus generates the caution again after a predetermined amount is printed.

2. The ink jet recording apparatus as claimed in claim 1, wherein the caution is generated each time a predetermined amount is printed.

3. The ink jet recording apparatus as claimed in claim 1, wherein if a cartridge replacement instruction is entered after the compatibility to the ink cartridge cannot be confirmed, the ink cartridge is moved to an ink cartridge replacement position.

4. The ink jet recording apparatus as claimed in claim 1, wherein after the recording apparatus generates the caution, the recording apparatus does not execute the subsequent print until the user inputs the continuation instruction.

5. An ink jet recording apparatus comprising an ink jet recording head for receiving supply of ink from an ink cartridge provided with storage means storing data and update storage means the recording apparatus further comprising:

default data storage means storing default data for controlling the recording head; and print control means, which reads the data from the storage means of the ink cartridge to determine compatibility when the ink cartridge is mounted, which, if compatible, stores the data read from the storage means of the ink cartridge in the update data storage means and controls the ink jet recording head based on the data in the storage means of the ink cartridge, which, if incompatible and data is available from the update data storage means, executes print operation based on the data available from the update storage means, and which if incompatible and no data is available from the update data storage means, executes print operation based on the data in the default data storage means.

6. The ink jet recording apparatus as claimed in claim 5, further comprising rewritable update data storage means, wherein the print control means is provided, which reads the data from the storage means of the ink cartridge to determine the compatibility when the ink cartridge is mounted, which, if compatible, updates data in the update data storage means based on the data in the storage means of the ink cartridge and controls the ink jet recording head based on the data in the storage means of the ink cartridge, and which, if incompatible, executes the print operation based on the data in the update data storage means or the data in the default data storage means.

7. The ink jet recording apparatus of claim 5, wherein the default data includes data relating to a print medium feeding speed.

8. An ink jet recording apparatus comprising an ink jet recording head for receiving supply of ink from an ink cartridge provided with storage means storing data for determining compatibility to a recording apparatus, and control means for determining compatibility of ink based on the data in the storage means and executing print operation, comprising:

optimum drive condition storage means storing an optimum drive condition for an ink cartridge, compatibility of which can be confirmed;

setup range storage means storing normal setup range data for comparison with ink information in the storage means of an ink cartridge;

general-purpose drive condition storage means storing a general-purpose drive condition for making it possible to reliably print even with an ink cartridge, compatibility of which cannot be confirmed; and a determination section which compares ink information read from the storage means of an ink cartridge with the normal setup range data, and executes printing using the optimum drive condition if the ink information is within the normal setup range, and executes printing using the general-purpose drive condition if the ink information is out of the normal setup range, wherein the general-purpose drive condition is set such that pressure for ejecting an ink droplet from the recording head is set larger than the optimum drive condition and that the record paper feed speed is set lower than the optimum drive condition.

9. An ink jet recording apparatus comprising an ink jet recording head for receiving supply of ink from an ink cartridge provided with storage means storing data for determining compatibility to a recording apparatus, and control means for determining compatibility of ink based on the data in the storage means and executing print operation, comprising:

optimum drive condition storage means storing an optimum drive condition for an ink cartridge, compatibility of which can be confirmed;

setup range storage means storing normal setup range data for comparison with ink information in the storage means of an ink cartridge;

general-purpose drive condition storage means storing a general-purpose drive condition for making it possible to reliably print even with an ink cartridge, compatibility of which cannot be confirmed; and a determination section which compares ink information read from the storage means of an ink cartridge with the normal setup range data, and executes printing using the optimum drive condition if the ink information is within the normal setup range, and executes printing using the general-purpose drive condition if the ink information is out of the normal setup range, wherein a plurality of the general-purpose drive conditions are provided so that reliable printing can be executed in association with the number or ratio of incompatible pieces of the attention ink information read from the storage element with respect to the normal setup range data.

10. An ink jet recording apparatus comprising an ink jet recording head for receiving supply of ink from an ink cartridge provided with storage means storing data for determining compatibility to a recording apparatus, and control means for determining compatibility of ink based on the data in the storage means and executing print operation, wherein if the ink cartridge is determined as being incompatible, the control means outputs data used as a guide for determining a compatible ink cartridge, wherein the data used as a guide is at least one of (1) displayed on an operational panel of the ink jet recording apparatus and (2) outputted to a display of a host computer, wherein the user guide data includes at least one of an address and a telephone number which a user can use to order or buy the compatible ink cartridge, and wherein the control means determines the compatibility of the mounted ink cartridge based on the data from the storage means when the mounted ink cartridge is to be replaced, and the control means outputs data for specifying that the mounted ink cartridge is compatible.

11. A method of determining compatibility of ink based on data stored in storage means of an ink cartridge for supplying ink to a recording head of an ink jet recording apparatus, the method comprising:

generating a caution and awaiting input of one of a continuation instruction and a cartridge replacement instruction by a user before executing a subsequent print operation if compatibility to an ink cartridge cannot be confirmed when the ink cartridge is mounted; and generating the caution again after a predetermined amount is printed if the recording apparatus executes the subsequent print operation upon input of the continuation instruction by the user.

12. A method of controlling an ink jet recording apparatus comprising an ink jet recording head for receiving supply of ink from an ink cartridge provided with storage means storing data and update storage means, comprising the steps of:

reading data from the storage means of the ink cartridge to determine compatibility of the ink cartridge when the ink cartridge is mounted to the recording apparatus;

storing the data read from the storage means of the ink cartridge in the update storage means and controlling the ink jet recording head based on the data in the storage means of the ink cartridge if the ink cartridge is compatible;

executing print operation based on the data available from the update storage means if the ink cartridge is incompatible and data is available from the update storage means; and executing print operation based on data stored in default data storage means if the ink cartridge is incompatible and no data is available from the update storage means.

13. The method of controlling an ink jet recording apparatus of claim 12, wherein the default storage means includes data relating to a print medium feeding speed.

14. A method of controlling an ink jet recording apparatus comprising an ink jet recording head for receiving supply of ink from an ink cartridge provided with storage means storing data for determining compatibility to a recording apparatus, the method comprising:

comparing ink information read from the storage means with normal setup range data;

executing print operation using optimum drive condition if the ink information is within the normal setup range; and executing print operation using general-purpose drive condition if the ink information contains information out of the normal setup range;

wherein the general-purpose drive condition is set such that pressure for ejecting an ink droplet from the recording head is set larger than the optimum drive condition and that the record paper feed speed is set lower than the optimum drive condition.

15. An ink jet recording apparatus comprising an ink jet recording head for receiving supply of ink from an ink cartridge provided with storage means storing data for determining compatibility to a recording apparatus, and control means for determining compatibility of ink based on the data in the storage means and executing print operation, wherein if the ink cartridge is determined as being incompatible, the control means outputs data used as a guide for determining a compatible ink cartridge, wherein the control means determines the compatibility of the mounted ink cartridge based on the data from the storage means when the mounted ink cartridge is to be replaced, and the control means outputs data for specifying that the mounted ink cartridge is compatible.

16. An ink jet recording apparatus to which an ink cartridge having storage means is mountable, the storage means has a predetermined format in which information relating to data items is stored in respective data fields, the recording apparatus comprising:

a recording head to which ink is supplied from the ink cartridge mounted on the recording apparatus;

an optimum drive condition storage section storing an optimum drive condition for an ink cartridge compatible to the recording apparatus;

a general purpose drive condition storage section storing a general-purpose drive condition for an ink cartridge incompatible to the recording apparatus;

a normal setup range storage section storing a normal setup range of at least one data field;

a determination section which compares a portion of the information corresponding to and read from the at least one data field with the normal setup range, and determines whether the read information has been damaged based on a result of the comparison;

a mode selection section which selects one of an optimum mode using the optimum drive condition and a general-purpose mode using the general-purpose drive condition based on the determination by the determination section;

a drive control section which controls printing by the recording head based on the selected one of the optimum drive mode and the general-purpose drive mode.

17. The recording apparatus according to claim 16, wherein if the read information is out of the normal setup range, the determination section determines that the read information is not reliable and the mode selection section selects the general-purpose mode.

18. The recording apparatus according to claim 16, wherein if the read information is within the normal setup range, the determination section determines that the read information is reliable and the mode selection section selects the optimum mode.

19. The recording apparatus according to claim 16, wherein if the read information is out of the normal setup range, the determination section determines that the mounted ink cartridge is the incompatible ink cartridge.

20. The recording apparatus according to claim 16, wherein the normal setup range storage section stores the normal setup ranges of selected ones of the data fields, and the determination section compares selected ones of portions of the information corresponding to and read from the selected ones of data fields with the normal setup ranges, respectively.

21. The recording apparatus according to claim 20, wherein if at least one of the selected portions of information is out of the corresponding normal setup range, the mode selection section selects the general-purpose mode.

22. The recording apparatus according to claim 20, wherein if all of the selected portions of information are within the corresponding normal setup ranges, the mode selection section selects the optimum mode.

23. The recording apparatus according to claim 20, wherein the general purpose drive condition storage section stores a plurality of the general-purpose drive conditions and the mode selection section selects a general-purpose mode using one of the general-purpose drive conditions depending on how many or what ratio the selected portions of information are out of the respective normal setup ranges.

24. The recording apparatus according to claim 16, wherein the data items includes at least two of manufacturing year, manufacturing month, manufacturing day, attachment year, attachment month, attachment day, ink type and color information.

25. The recording apparatus according to claim 16, wherein the data items includes technical information pieces and additional information pieces, and the determination section uses at least one of the technical information pieces for the comparison.

26. The recording apparatus according to claim 16, wherein pressure for ejecting an ink droplet from the recording head is larger in the general-purpose drive condition than in the optimum drive condition.

27. The recording apparatus according to claim 16, wherein recording paper feed speed is lower in the general-purpose drive condition than in the optimum drive condition.

28. A method of controlling an ink jet recording apparatus comprising an ink jet recording head provided with storage means with a predetermined format in which information relating to data items are stored in respective data fields storing data for determining compatibility to a recording apparatus, the method comprising:

comparing a portion of the information corresponding to and read from the at least one data field with a normal setup range, determining whether the read information has been damaged based on a result of the comparison;

selecting one of an optimum mode using an optimum drive condition and a general-purpose mode using a general-purpose drive condition based on a result of the determining;

controlling printing by the recording head based on the selected one of the optimum drive mode and the general-purpose drive mode.

* * * * *